US008063731B2

(12) United States Patent
Weiss

(10) Patent No.: US 8,063,731 B2
(45) Date of Patent: Nov. 22, 2011

(54) MATCHED RF RESISTOR HAVING A PLANAR LAYER STRUCTURE

(75) Inventor: Frank Weiss, Radeberg (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 774 days.

(21) Appl. No.: 12/089,146

(22) PCT Filed: Oct. 9, 2006

(86) PCT No.: PCT/EP2006/009736

§ 371 (c)(1),
(2), (4) Date: Jul. 15, 2008

(87) PCT Pub. No.: WO2007/042243

PCT Pub. Date: Apr. 19, 2007

(65) Prior Publication Data

US 2009/0206981 A1 Aug. 20, 2009

(30) Foreign Application Priority Data

Oct. 11, 2005 (DE) ..... 20 2005 015 927 U

(51) Int. Cl.
*H01C 1/012* (2006.01)

(52) U.S. Cl. ..... 338/308; 338/195; 338/330

(58) Field of Classification Search ..... 338/308, 338/195, 216–217, 138, 206, 330, 333
See application file for complete search history.

(56) References Cited

U.S. PATENT DOCUMENTS 4,267,531 A * 5/1981 Spinner et al. ..... 333/22 R
5,043,694 A * 8/1991 Higashi et al. ..... 338/195
6,007,755 A * 12/1999 Hoshii et al. ..... 264/400
6,184,775 B1 * 2/2001 Gerber et al. ..... 338/195

FOREIGN PATENT DOCUMENTS

DE 1945839 A1 3/1971
DE 2634812 A1 2/1978
DE 3843600 C1 3/1990

* cited by examiner

*Primary Examiner* — Kyung Lee
(74) *Attorney, Agent, or Firm* — DeLio & Peterson, LLC; Robert Curcio

(57) ABSTRACT

The invention relates to an RF resistor, and in particular an RF terminating resistor, having a planar layer structure which has, on a substrate (16), a resistive layer (10) for converting RF energy into heat, an input conductor track (12) for the infeed of RF energy, and an earthing conductor track (14) for making an electrical connection to an earth contact, the input conductor track (12) being electrically connected to a first end (18) of the resistive layer (10), the earthing conductor track (14) being electrically connected to a second end (20) of the resistive layer which is opposite from the first end (18), and the resistive layer (10) being bounded, between the first end (18) and the second end (20), by lateral faces (26) in a direction perpendicular to a direction of propagation (22) of the RF energy in the resistive layer (10) and perpendicular to a normal (24) to the planar layer structure, the resistive layer (10) having at least one incision, which at least partly constricts the cross-section of the resistive layer (10), to match the characteristic impedance to a predetermined value. The incision (28) is formed to be spaced away from the lateral faces (26) of the resistive layer (10) in this case.

20 Claims, 2 Drawing Sheets

MATCHED RF RESISTOR HAVING A PLANAR LAYER STRUCTURE

The present invention relates to an RF resistor, and in particular an RF terminating resistor, having a planar layer structure which has, on a substrate, a resistive layer for converting RF energy into heat, an input conductor track for the infeed of RF energy, and an earthing conductor track for making an electrical connection to an earth contact, the input conductor track being electrically connected to a first end of the resistive layer, the earthing conductor track being electrically connected to a second end of the resistive layer which is opposite from the first end, and the resistive layer being bounded, between the first end and the second end, by lateral faces in a direction perpendicular to a direction of propagation of the RF energy in the resistive layer and perpendicular to a normal to the planar layer structure, the resistive layer having at least one incision, which at least partly constricts the cross-section of the resistive layer, to match the characteristic impedance to a predetermined value, as defined in the preamble to claim 1. The invention also relates to a method of matching the characteristic impedance of an RF resistor, and in particular an RF terminating resistor, having a planar layer structure which has, on a substrate, a resistive layer for converting RF energy into heat, an input conductor track for the infeed of RF energy, and an earthing conductor track for making an electrical connection to an earth contact, the input conductor track being electrically connected to a first end of the resistive layer, the earthing conductor track being electrically connected to a second end of the resistive layer which is opposite from the first end, and the resistive layer being bounded, between the first end and the second end, by lateral faces in a direction perpendicular to a direction of propagation of the RF energy in the resistive layer and perpendicular to a normal to the planar layer structure, there being formed in the resistive layer at least one incision, which at least partly constricts the cross-section of the resistive layer, to match the characteristic impedance to a predetermined value, as defined in the preamble to claim 9.

To make the RF resistor wide-band, the structure of the resistive layer is matched to the ambient conditions relevant for radio frequencies. To match RF terminating resistors of the above kind, it is known for a planar region at the edge of the resistive layer to be electrically de-activated by an incision or for deep incisions to be formed in the cross-section of the structure. However, if this is done the problem arises that high current densities occur locally in the region of the incisions and these give rise to high temperatures in the resistive layer. The result of this is that the RF resistor is then only suitable for narrow-band use or may possibly have to be sorted out of production as scrap which is unfit for use.

The object underlying the invention is to improve an RF resistor of the above kind in such a way that, while the yield of the production process is as high as possible and excellent RF properties are preserved, use is made of increased dissipated power and the heat in the resistive layer is distributed in an optimum manner by the matching of the characteristic impedance.

This object is achieved in accordance with the invention by an RF resistor of the above kind which has the features characterised in claim 1 and by a method of the above kind which has the features specified in claim 9. Advantageous embodiments of the invention are described in the other claims.

In an RF resistor of the above kind, provision is made in accordance with the invention for the incision to be formed to be spaced away from the lateral faces of the resistive layer.

This has the advantage that a beneficial heat distribution which prevents hot spots from occurring due to increased current density is obtained even in the region of the incision.

The incision is usefully so formed that it completely interrupts the cross-section of the resistive layer in the direction of the normal to the planar layer structure. A region of the resistive layer which is situated downstream of the incision in the direction of propagation of the RF energy is completely de-activated by this means and no longer makes any contribution to the conduction of current from the input conductor track at the first end of the resistive layer to the earthing conductor track at the second end of the resistive layer, as a result of which the electronic ohmic resistance (sheet resistance) is altered accordingly over the whole of the resistive layer.

By forming the incision to be U-shaped in the plane of the resistive layer, with the U having two sides and a bottom which connects the two sides and with an open end of the U-shaped incision being formed to be adjacent the second end of the resistive layer, and with the sides of the U-shaped incision being formed to be substantially longer than the bottom of the U-shaped incision, a current density in the resistive layer is uniformly distributed over the length of the resistive layer in the direction of propagation of the RF energy, and any heat generation in the resistive layer in the region of the incision is thereby distributed over a larger area.

For the particularly fine setting of the sheet resistance, an extension of the incision is formed at each of those free ends of the sides of the U-shaped incision which are remote from the bottom. These extensions are usefully formed to be symmetrical to one another.

In a preferred embodiment, the incision is arranged centrally between the lateral faces of the resistive layer.

In a method of the above kind, provision is made in accordance with the invention for the incision to be formed to be spaced away from the lateral faces of the resistive layer.

This has the advantage that a beneficial heat distribution which prevents hot spots from occurring due to increased current density is obtained even in the region of the incision.

Usefully, in a method of the above kind, the incision is so formed that it completely interrupts the cross-section of the resistive layer in the direction of the normal to the planar layer structure. A region of the resistive layer which is situated downstream of the incision in the direction of propagation of the RF energy is completely de-activated by this means and no longer makes any contribution to the conduction of current from the input conductor track at the first end of the resistive layer to the earthing conductor track at the second end of the resistive layer, as a result of which the characteristic impedance is altered accordingly over the whole of the resistive layer.

By, in a method of the above kind, forming the incision to be U-shaped in the plane of the resistive layer, with the U having two sides and a bottom which connects the two sides and with an open end of the U-shaped incision being formed to be adjacent the second end of the resistive layer, and with the sides of the U-shaped incision being formed to be substantially longer than the bottom of the U-shaped incision, a current density in the resistive layer is uniformly distributed over the length of the resistive layer in the direction of propagation of the RF energy and any heat generation in the resistive layer in the region of the incision is thereby distributed over a larger area.

For the particularly fine setting of the characteristic impedance, there is formed, in a method of the above kind, an extension of the incision at each of those free ends of the sides of the U-shaped incision which are remote from the bottom. These extensions are usefully formed to be symmetrical to one another.

In a preferred embodiment of the above method, the incision is arranged centrally between the lateral faces of the resistive layer.

The invention is explained in detail below by reference to the drawings. In the drawings.

Figure 1:
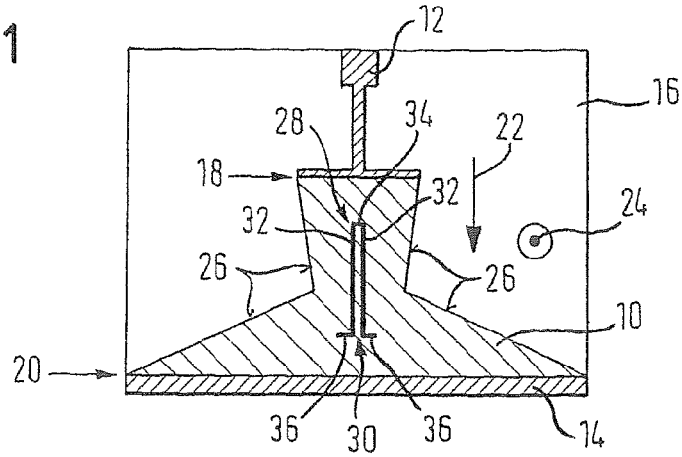
FIG. 1 is a plan view of a preferred embodiment of RF resistor according to the invention.

The preferred embodiment of RF terminating resistor according to the invention which can be seen in FIG. 1 comprises a resistive layer 10, an input conductor track 12 and an earthing conductor track 14. The resistive layer 10, the input conductor track 12 and the earthing conductor track 14 are in the form of respective layers on a substrate 16 and form a planar layer structure. The input conductor track 12 is electrically connected to a first end 18 of the resistive layer 10 and the earthing conductor track 14 is electrically connected to a second end 20 of the resistive layer 10 which is opposite from the first end 18. The resistive layer 10 serves to convert RF energy into heat, the input conductor track 12 serves to feed in RF energy and the earthing conductor track 14 serves to make an electrical connection to an earth contact (not shown).

Between the first end 18 and the second end 20, in the direction perpendicular to the direction of propagation 22 of the RF energy in the resistive layer 10 and perpendicular to a normal 24 to the planar layer structure, the resistive layer 10 is bounded by lateral faces 26. To match the characteristic impedance to a predetermined value in the resistive layer 10, there is formed, in accordance with the invention, a U-shaped incision 28 which at least partly constricts the cross-section of the resistive layer, the U-shaped incision 28 being centrally arranged between the lateral faces 26 in such a way that an open end 30 of the U-shaped incision 28 is adjacent the second end 20 of the resistive layer 10. The U-shaped incision 28 is formed to have two parallel sides 32 and a bottom 34 which connects the sides 32 together, with the sides 32 extending parallel to the direction of propagation 22 of the RF energy in the resistive layer 10 and being formed to be substantially longer than the bottom 34. This gives a relatively large electrically de-activated region between the sides 32 while at the same time the electrically active cross-section in the region of the incision 28 remains relatively large. As a result, the current density is distributed over a large region of the cross-section and any locally restricted points at which the current density is high are avoided. This distributes the thermal energy produced over a larger region and any locally restricted points at which the temperature is high are thus avoided.

To make the RF resistor according to the invention wideband, the structure of the resistive layer is thus matched to the ambient conditions which are relevant for radio frequencies, the matching being performed in accordance with the invention in the longitudinal direction in the centre of the structure at a point which is favourable for the distribution of heat, and at the same time the effect that is produced is for matching to matched values which are as good as possible. Whereas, in the conventional method of matching sheet resistance, hot spots occur as a result of increased current density, with the incision 28 formed in accordance with the invention current density is uniformly distributed over the length of the resistive structure 10 in the direction of propagation 22 of the RF energy. The area of the resistor through which current flows is substantially wider.

Figure 2:
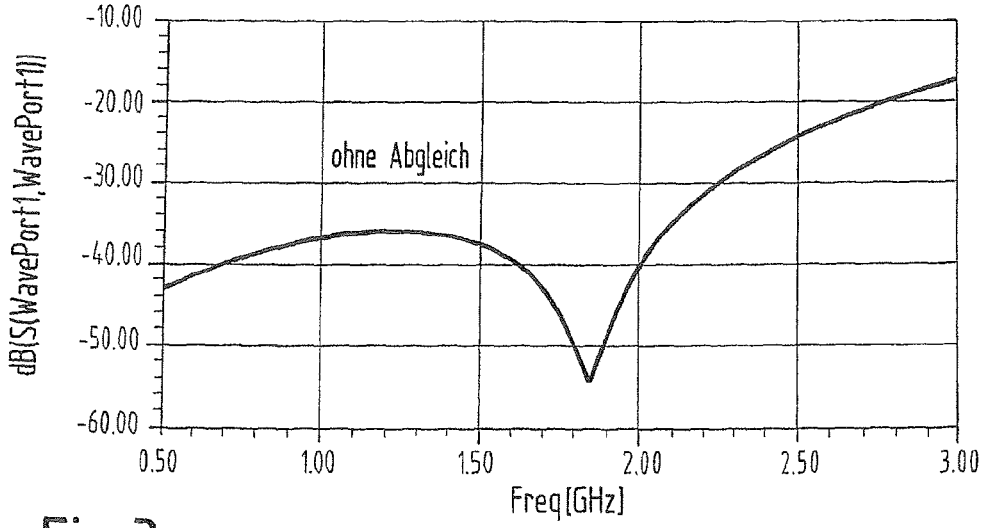
FIG. 2 is a graph showing the matching of characteristic impedance against frequency for the RF resistor shown in FIG. 1 when it does not have matching by means of an incision.
Figure 3:
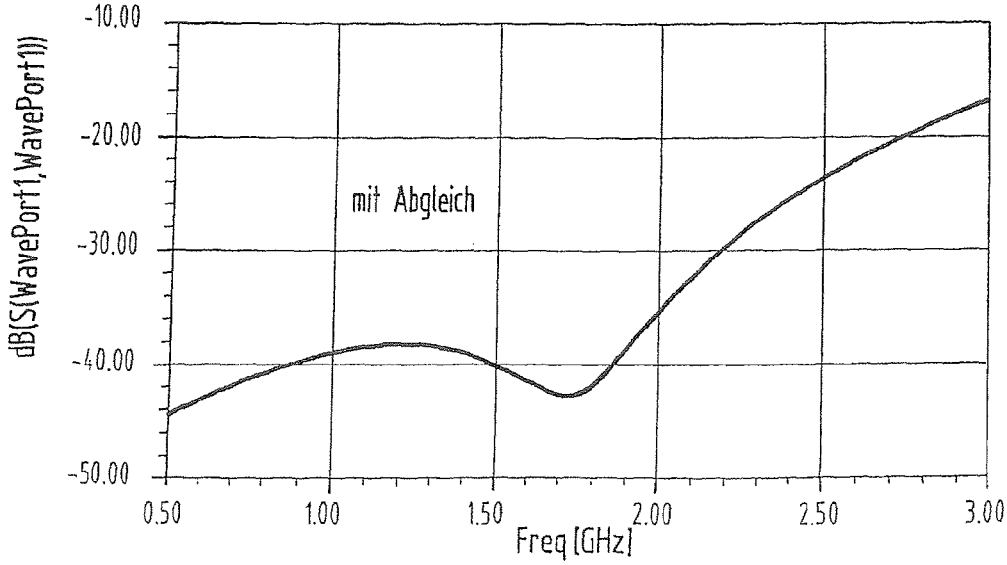
FIG. 3 is a graph showing the matching of characteristic impedance against frequency for the RF resistor shown in FIG. 1 when it does have matching by means of the incision according to the invention.

FIGS. 2 and 3 show the advantageous effect of the incision 28 according to the invention on the sheet resistance of the resistive layer 10. The values in FIGS. 2 and 3 were determined from simulations.

Figure 4:
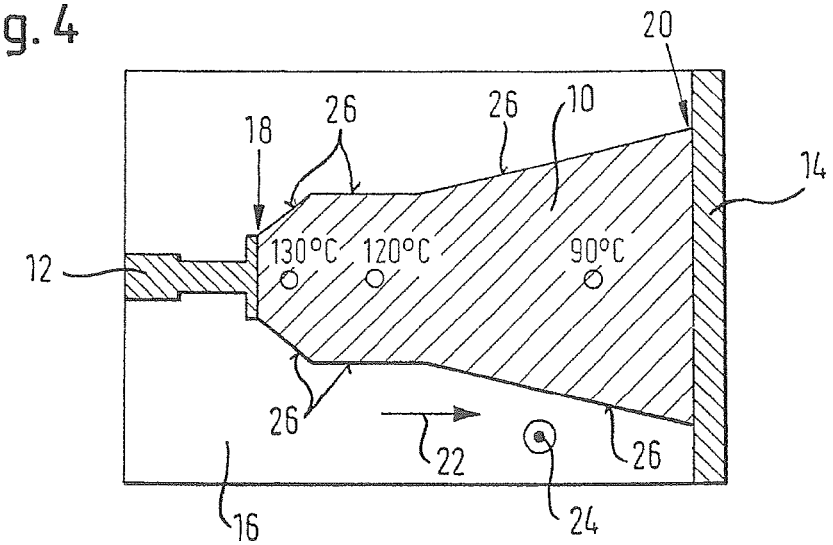
FIG. 4 is a plan view of an alternative embodiment of RF resistor which does not have matching by means of the incision according to the invention.
Figure 5:
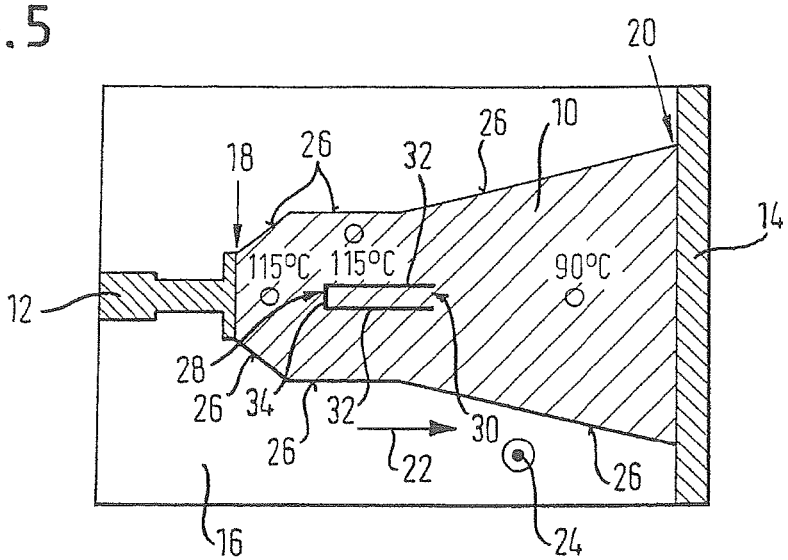
FIG. 5 is a plan view of a first preferred embodiment of the RF resistor shown in FIG. 4 which has matching by means of the incision according to the invention.
Figure 6:
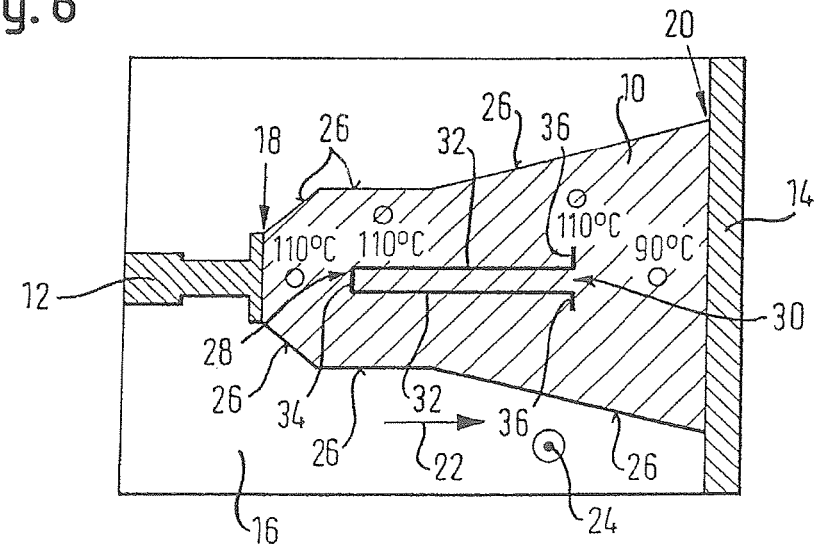
FIG. 6 is a plan view of a second preferred embodiment of the RF resistor shown in FIG. 4 which has matching by means of the incision according to the invention.

FIGS. 4 to 6 show values for temperature which were determined by experiment at various points in the resistive structure 10 when there was no matching (FIG. 4), when there was matching by means of a first embodiment of incision 28 (FIG. 5), and when there was matching by means of a second embodiment of incision 28 (FIG. 6). In the case of the first embodiment of incision 28, which is shown in FIG. 5, the incision 28 is formed to be purely U-shaped and has sides 32 and a bottom 34. In the case of the second embodiment of incision 28, which is shown in FIG. 6, the incision 28 is formed as in FIG. 5 to be U-shaped and has in addition, at free ends of the sides 32, extensions 36 of the incision 28 which extend perpendicularly to the sides 32, which means that these extensions 36 are perpendicular to the direction of propagation 22 of the RF energy and mask off an additional area of the resistive structure 10 against the flow of current, i.e. they electrically de-activate this additional area, meaning that this additional area plays no part in the flow of current from the first end 18 to the second end 20. Additional action is taken in this way on the electrical ohmic resistance (sheet resistance) of the resistive layer 10.

The trend followed by temperature distribution in the resistive layer as a function of the matching slot which is selected can clearly be seen. The matching by the incision 28 according to the invention is very easy to accomplish in technological terms and produces a uniform temperature distribution even, or rather precisely, when the matching slots are very large. In contrast to extreme incisions (I cuts) such as are usual in the prior art, with the incision 28 according to the invention the temperature is even brought down as a result of the uniform distribution when there is a large match. Due to the high dissipated powers, resistive structures are obtained whose dimensions are large in comparison with the wavelength. To enable good matches to the load to be achieved nevertheless, the resistive structure 10 on the substrate 16, and in particular the resistive area in the longitudinal direction 22, is matched by a varying width for the structure. The possibility of making the incision 28 for matching relatively long also has a positive effect on the reflectance factor. All in all, the following advantages are achieved: a constant heat distribution (no hot spots), assurance of very good reflectance factors over the entire bandwidth, and a reduction in costs due to a high yield from production.

The beneficial characteristics of the new method of matching have a direct effect on the use of a resistor substrate. For the purposes of practical use, there are incidental conditions which have to be satisfied. These could for example be maximum temperature stresses on soldered joints or maximum permitted temperature compatibilities of resistive layers. Because of the advantageous properties, the invention is particularly suitable for the production of RF resistors in large numbers (mass production, production-line production).

A method of matching the characteristic impedance of an RF resistor, and in particular an RF terminating resistor, having a planar layer structure which has, on a substrate, a resistive layer for converting RF energy into heat, an input conductor track for the infeed of RF energy, and an earthing conductor track for making an electrical connection to an earth contact, the input conductor track being electrically connected to a first end of the resistive layer, the earthing conductor track being electrically connected to a second end of the resistive layer which is opposite from the first end, and the resistive layer being bounded, between the first end and the second end, by lateral faces in a direction perpendicular to a direction of propagation of the RF energy in the resistive layer and perpendicular to a normal to the planar layer structure, there being formed in the resistive layer, to match the characteristic impedance to a predetermined value, at least one incision which at least partly constricts the cross-section of the resistive layer, is characterised in that the incision is formed to be spaced away from the lateral faces of the resistive layer.

This has the advantage that a beneficial heat distribution which prevents hot spots from occurring due to increased current density is obtained even in the region of the incision.

Usefully, in a method of the above kind the incision is so formed that it completely interrupts the cross-section of the resistive layer in the direction of the normal to the planar layer structure. A region of the resistive layer which is situated downstream of the incision in the direction of propagation of the RF energy is completely de-activated by this means and no longer makes any contribution to the conduction of current from the input conductor track at the first end of the resistive layer to the earthing conductor track at the second end of the resistive layer, as a result of which the sheet resistance is altered accordingly over the whole of the resistive layer.

By, in a method of the above kind, forming the incision to be U-shaped in the plane of the resistive layer, with the U having two sides and a bottom which connects the two sides and with an open end of the U-shaped incision being adjacent the second end of the resistive layer, and with the sides of the U-shaped incision being formed to be substantially longer than the bottom of the U-shaped incision, a current density in the resistive layer is uniformly distributed over the length of the resistive layer in the direction of propagation of the RF energy and any heat generation in the resistive layer in the region of the incision is thereby distributed over a larger area.

For the particularly fine setting of the characteristic impedance, there is formed, in a method of the above kind, an extension of the U-shaped incision at each of those free ends of the sides of the incision which are remote from the bottom. These extensions are usefully formed to be symmetrical to one another.

In a preferred embodiment of the above method, the incision is formed centrally between the lateral faces of the resistive layer.

The invention claimed is:

1. An RF resistor having a planar layer structure on a substrate comprising a resistive layer for converting RF energy into heat, an input conductor track for the infeed of RF energy, and an earthing conductor track for making an electrical connection to an earth contact, the input conductor track being electrically connected to a first end of the resistive layer, the earthing conductor track being electrically connected to a second end of the resistive layer which is opposite from the first end, and the resistive layer being bounded, between the first end and the second end, by lateral faces in a direction perpendicular to a direction of propagation of the RF energy in the resistive layer and perpendicular to a normal to the planar layer structure, the resistive layer having at least one incision, which at least partly constricts the cross-section of the resistive layer, to match the characteristic impedance to a predetermined value, the incision being formed to be spaced away from the lateral faces of the resistive layer, characterised in that the incision is formed to be U-shaped in the plane of the resistive layer, with the U having two sides and a bottom which connects the sides.

2. The RF resistor of claim 1, including forming the incision so that it completely interrupts the cross-section of the resistive layer in the direction of the normal to the planar layer structure.

3. The RF resistor of claim 1 including having the sides of the U-shaped incision formed to be substantially longer than the bottom of the U-shaped incision.

4. The RF resistor of claim 1, including having an open end of the U-shaped incision adjacent the second end of the resistive layer.

5. The RF resistor of claim 2, including having an open end of the U-shaped incision adjacent the second end of the resistive layer.

6. The RF resistor of claim 1 including having an extension of the U-shaped incision formed at each free end of the sides of the incision which are remote from the bottom.

7. The RF resistor of claim 2 including having an extension of the U-shaped incision formed at each free end of the sides of the incision which are remote from the bottom.

8. The RF resistor of claim 4 including having an extension of the U-shaped incision formed at each free end of the sides of the incision which are remote from the bottom.

9. The RF resistor of claim 6 including having the extensions formed to be symmetrical to one another.

10. The RF resistor of claim 1 wherein the incision is arranged centrally between the lateral faces of the resistive layer.

11. A method of matching the characteristic impedance of an RF resistor having a planar layer structure comprising, on a substrate, a resistive layer for converting RF energy into heat, an input conductor track for the infeed of RF energy, and an earthing conductor track for making an electrical connection to an earth contact, the input conductor track being electrically connected to a first end of the resistive layer, the earthing conductor track being electrically connected to a second end of the resistive layer which is opposite from the first end, and the resistive layer being bounded, between the first end and the second end, by lateral faces in a direction perpendicular to a direction of propagation of the RF energy in the resistive layer and perpendicular to a normal to the planar layer structure, there being formed in the resistive layer, to match the characteristic impedance to a predetermined value, at least one incision which at least partly constricts the cross-section of the resistive layer, the incision being formed to be spaced away from the lateral faces of the resistive layer, characterized in that the incision is formed to be U-shaped in the plane of the resistive layer, with the U having two sides and a bottom which connects the two sides.

12. The method of claim 11 including having the incision so formed that it completely interrupts the cross-section of the resistive layer in the direction of the normal to the planar layer structure.

13. The method of claim 11 including having the U-shaped incision formed to have an open end of the U-shaped incision adjacent the second end of the resistive layer.

14. The method of claim 12 including having the U-shaped incision formed to have an open end of the U-shaped incision adjacent the second end of the resistive layer.

15. The method of claim 12 including having the sides of the U-shaped incision formed to be substantially longer than the bottom of the U-shaped incision.

16. The method of claim 11 including forming an extension of the U-shaped incision at each of those free ends of the sides of the incision which are remote from the bottom.

17. The method of claim 12 including forming an extension of the U-shaped incision at each of those free ends of the sides of the incision which are remote from the bottom.

18. The method of claim 13 including forming an extension of the U-shaped incision at each of those free ends of the sides of the incision which are remote from the bottom.

19. The method of claim 18 including having said extensions formed to be symmetrical to one another.

20. The method of claim 11 including having the incision formed centrally between the lateral faces of the resistive layer.

* * * * *